US006668502B2

(12) United States Patent
Béliveau

(10) Patent No.: US 6,668,502 B2
(45) Date of Patent: Dec. 30, 2003

(54) LEDGER MOULD FOR BUILDING A LEDGER

(75) Inventor: Jean-Louis Béliveau, Magog (CA)

(73) Assignee: Polyform A.G.P. Inc., Quebec (CA)

( * ) Notice: Subject to any disclaimer, the term of this patent is extended or adjusted under 35 U.S.C. 154(b) by 21 days.

(21) Appl. No.: 09/947,994

(22) Filed: Sep. 6, 2001

(65) Prior Publication Data

US 2002/0104279 A1 Aug. 8, 2002

(30) Foreign Application Priority Data

Feb. 8, 2001 (CA) ..... 2334614

(51) Int. Cl.[7] ..... E04G 13/00; E04B 2/86

(52) U.S. Cl. ..... 52/426; 52/745.09; 249/188; 249/207

(58) Field of Search ..... 52/309.12, 309.15, 52/309.17, 425, 426, 433, 437, 439, 440, 441, 745.09; 249/207, 188

(56) References Cited

U.S. PATENT DOCUMENTS

| | | | | |
|---|---|---|---|---|
| 3,650,079 A | * | 3/1972 | Lubin | 52/439 |
| 3,895,469 A | | 7/1975 | Kapitan | |
| 4,229,920 A | | 10/1980 | Lount | |
| 4,706,429 A | | 11/1987 | Young | |
| 4,884,382 A | | 12/1989 | Horobin | |
| 4,885,888 A | | 12/1989 | Young | |
| 4,894,969 A | | 1/1990 | Horobin | |
| 5,428,933 A | | 7/1995 | Philippe | |
| 5,459,971 A | | 10/1995 | Sparkman | |
| 5,553,432 A | * | 9/1996 | Levin | 52/309.12 |
| 5,625,989 A | | 5/1997 | Brubaker et al. | |
| 5,657,600 A | * | 8/1997 | Mensen | 52/426 |
| 5,735,093 A | | 4/1998 | Grutsch | |
| 5,809,728 A | | 9/1998 | Tremelling | |
| 5,839,243 A | * | 11/1998 | Martin | 52/439 |
| 6,314,697 B1 | * | 11/2001 | Moore, Jr. | 52/426 |

FOREIGN PATENT DOCUMENTS

| | | |
|---|---|---|
| CA | 2193630 | 12/1995 |

* cited by examiner

*Primary Examiner*—Michael Safavi
(74) *Attorney, Agent, or Firm*—St. Onge Steward Johnston & Reens LLC

(57) ABSTRACT

A ledger mould assembly is suitable for use with a wall form assembly of the type comprising a pair of spaced-apart parallel foam panels defining therebetween a cavity for the setting of a flowable material for building an insulated wall. The ledger mould is used to receive a hardening flowable material and integrally forming a ledger to the wall. The ledger mould assembly comprises an elongated mould made of foam having a planar front face spanning from top to bottom, a tapered bottom edge and at least one flared recess in the front face, opening outwardly and upwardly from bottom to top. Mounting means are provided for horizontally mounting the mould against either one of the foam panels with the bottom down and the planar front face of the ledger mould in contact with the planar outside face of the foam panel. This set-up allows flowable hardening material to be poured from the top of the mould into the flared recesses to form a ledger once it has hardened.

18 Claims, 6 Drawing Sheets

LEDGER MOULD FOR BUILDING A LEDGER

FIELD OF THE INVENTION

The present invention relates, in general, to the field of construction. More particularly, it concerns a form adapted to receive a flowable material such as concrete in order to build a ledger for either supporting a brick wall or the ends of floor or ceiling joists. The ledger form disclosed herein is particularly useful when used in combination with a wall form assembly of the type comprising connectable foam panels for building insulated concrete walls, the foam panels being settable in parallel relationship.

BACKGROUND OF THE INVENTION

A number of different systems and methods currently exists for making insulating forms for casting a concrete wall. Often, these systems comprise pairs of opposed foam panels generally made of rigid foam like polystyrene, which define concrete-receiving cavities therebetween. Those pairs of foam panels are placed one above the other so to form the wall form. Once the concrete is solidified, the wall forms remain in place to insulate the wall. Those wall forms are typically maintained in spaced and parallel relationship, before the pouring of concrete, by means of connectors comprising a pair of parallel lateral attachment flange plates each inserted in one of the two opposed foam panels, and a connecting web interconnecting the flanges.

The piling up of such panels is performed on the construction site. One object in this field is to obtain foam panels that allow, on one hand, an easy and very rapid piling up without losing time and, on the other hand, the construction of a stable and solid stacking that is unlikely to disassemble prior to the pouring of concrete. As can be easily understood, as soon as the concrete is poured, the chances that the stack collapses or disassembles are greatly reduced. Examples of such prior art wall form assemblies for concrete walls are given in U.S. Pat. Nos. 3,895,469; 4,229,920; 4,706,429; 4,884,382; 4,885,888; 4,894,969; 5,428,933; 5,459,971; 5,625,989; 5,657,600; 5,735,093 and 5,809,728.

Also known in the prior art, is a concrete form for building a brick ledger on which a facing made of brick can be erected. This element is disclosed in the Canadian patent application CA 2,193,630. This type of concrete form for a brick ledger is adapted to be used in combination with a wall form assembly as described above, which comprises a pair of spaced-apart foam panels including an outside foam panel and an inside foam panel. The brick ledger form consists of an elongated foam panel having the bottom mountable on top of the outside foam panel of the form wall system. The foam member has a substantially straight lower portion, a flared upper portion and spaced-apart reinforcement bridges along the length of the foam member. In use, the brick ledger form is set on top of the outside foam panel and a planar foam panel is set in front of the brick ledger form on the inside foam panel, thereby forming a flared recess therebetween. The foam panel and the brick ledger form are tied to each other by means of connecting web members each having one flange inserted in the reinforcement bridge of the brick ledger and another flange inserted in the facing foam panel. The concrete devised to form the brick ledger is poured in the flared recess so to form a brick ledger on which a brick facing can be erected. One drawback with such brick ledger form, among others, is that it only allows the construction of a ledger at a specific height on the main wall since the form is designed to be installed on top of a foam panel. Thus, the level at which the brick ledger can be built is directly dependent on the level at which the top edge of the foam panel extends.

SUMMARY OF THE INVENTION

An object of the present invention is to provide an improved form for building a ledger which is believed to be more flexible or adaptable than the known ledger form.

In accordance with the present invention, that object is achieved with a ledger mould assembly for use with a wall form assembly, the wall form assembly comprising a pair of spaced-apart parallel foam panels defining therebetween a cavity for the setting of a flowable material for building an insulated wall. The ledger mould is used to receive a hardening flowable material and to integrally form a ledger to the wall. The mould assembly comprises an elongated mould made of foam. The mould has a front, a back, a top, a bottom, a planar front face spanning from top to bottom, a tapered bottom edge and at least one flared recess in the front face, opening outwardly and upwardly from bottom to the top. The mould assembly further comprises mounting means for horizontally mounting the mould against a planar outside face of one of the foam panels with the bottom down and the planar front face of the ledger mould in contact with the planar outside face of the foam panel. This set-up allows flowable material to be poured from the top of the mould into the at least one flared recess to form a ledger.

According to another aspect, the present invention provides a kit for building an insulated wall with a ledger, the kit comprising:

- a pair of foam panels tied together by means of connectors, each panel having a top, a bottom, an inside face and a planar outside face; the foam panels being settable in a spaced-apart relationship for forming a cavity between the inside face of each panel for receiving a flowable material;
- an elongated ledger mould made of foam for forming a ledger to the wall, the ledger mould having:
  - a front, a back, a top and a bottom;
  - a planar front face spanning from top to bottom;
  - a tapered bottom edge; and
  - at least one flared recess in the front face, opening outwardly and upwardly from bottom to the top; and
- mounting means for horizontally mounting the mould against the planar outside face of either one of the foam panels with the bottom down and the planar front face contacting the planar outside face of the panel and thereby allowing flowable material to be poured from the top of the ledger mould into the at least one flared recess to form a ledger.

According to a further aspect, the present invention provides a method for making an insulated wall with a ledger, comprising the steps of: a) providing a kit as described above, b) setting the foam panels in a spaced apart relationship, c) mounting the ledger mould horizontally on the planar outside face of either one of the foam panels, d) cutting and removing the foam material of the foam panel then facing the at least one flared recess to provide a full fluid communication between the at least one flared recess and the cavity between the foam panels and e) pouring a flowable and hardening material into the at least one flared recess and the cavity between the foam panels.

According to a still further aspect, the present invention also provides a ledger mould assembly for use with a wall form assembly, the wall form assembly comprising a pair of spaced-apart parallel foam panels defining therebetween a cavity for the setting of a flowable material for building an insulated wall, the ledger mould being for receiving a hardening flowable material and integrally forming a ledger to the wall, the mould assembly comprising:

an elongated mould made of foam and having:

a front, a back, a top and a bottom;

a planar front face spanning from top to bottom;

a tapered bottom edge;

a plurality of flared recesses in the front face, opening outwardly and upwardly from bottom to the top; and a transversal partition wall separating each two adjacent flared recesses, each partition wall having a top edge including an upwardly protruding portion mounting means for horizontally mounting the mould against a planar outside face of one of the foam panels with the bottom down and the planar front face of the ledger mould contacting the planar outside face of the foam panel and thereby allowing flowable material to be poured from the top of the mould into the flared recesses to form a ledger, the mounting means comprising:

a V-shaped bracket shaped to receive and support the tapered bottom edge of the mould;

a set of capping brackets each comprising:

a cap-shaped portion adapted to fit on the upwardly protruding portion of each partition wall; and a flange extending at right angle on a side of the cap-shaped portion; and a set of fasteners to secure the V-shaped and capping brackets to the planar outside face of the panel.

As can be appreciated, the ledger form mould according to the invention is very flexible, as it can be mounted anywhere, at any level on a foam panel, depending on where a ledger is required.

Other features and objects of the present invention will become more apparent from the description of a preferred embodiment that follows, having reference to the appended drawings and given as examples only as to how the invention may be put into practice.

While the invention will be described in conjunction with a preferred embodiment, it will be understood that it is not intended to limit the scope of the invention to such embodiment. On the contrary, it is intended to cover all alternatives, modifications and equivalents as may be included as defined by the appended claims.

DESCRIPTION OF A PREFERRED EMBODIMENT

Figure 1:
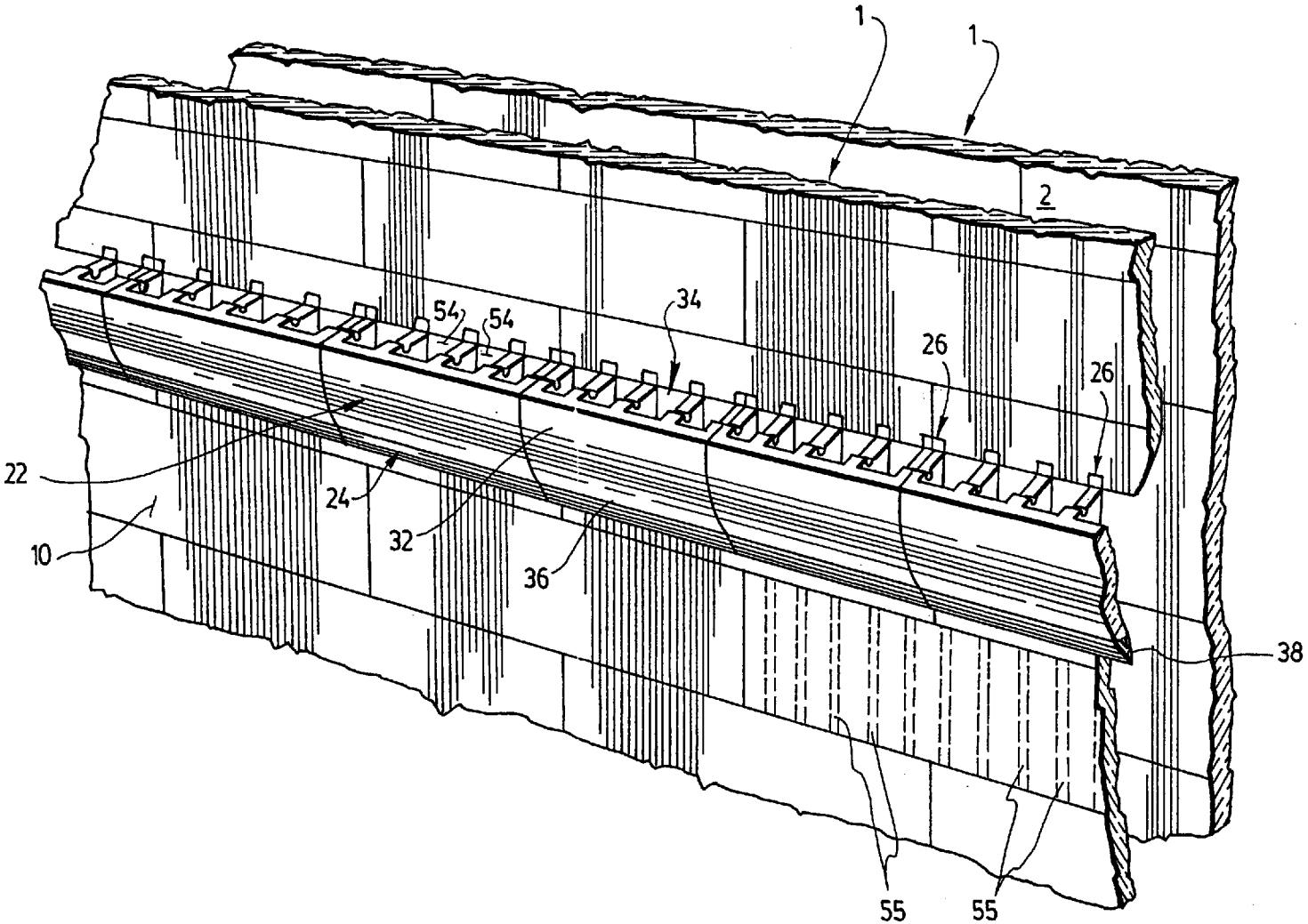
FIG. 1 is a perspective view of a number of aligned ledger moulds according to a preferred embodiment of the invention mounted against a wall form assembly thereby forming a ledger to the wall.

As shown in FIG. 1, the ledger mould assembly is suitable for building a ledger to a wall and is particularly useful when used in combination with a conventional wall form assembly used for the construction of insulated concrete walls. The ledger so formed with the ledger mould can be constructed either on the outside of the building for supporting a brick wall or on the inside for supporting the ends of floor or ceiling joists.

Figure 2:
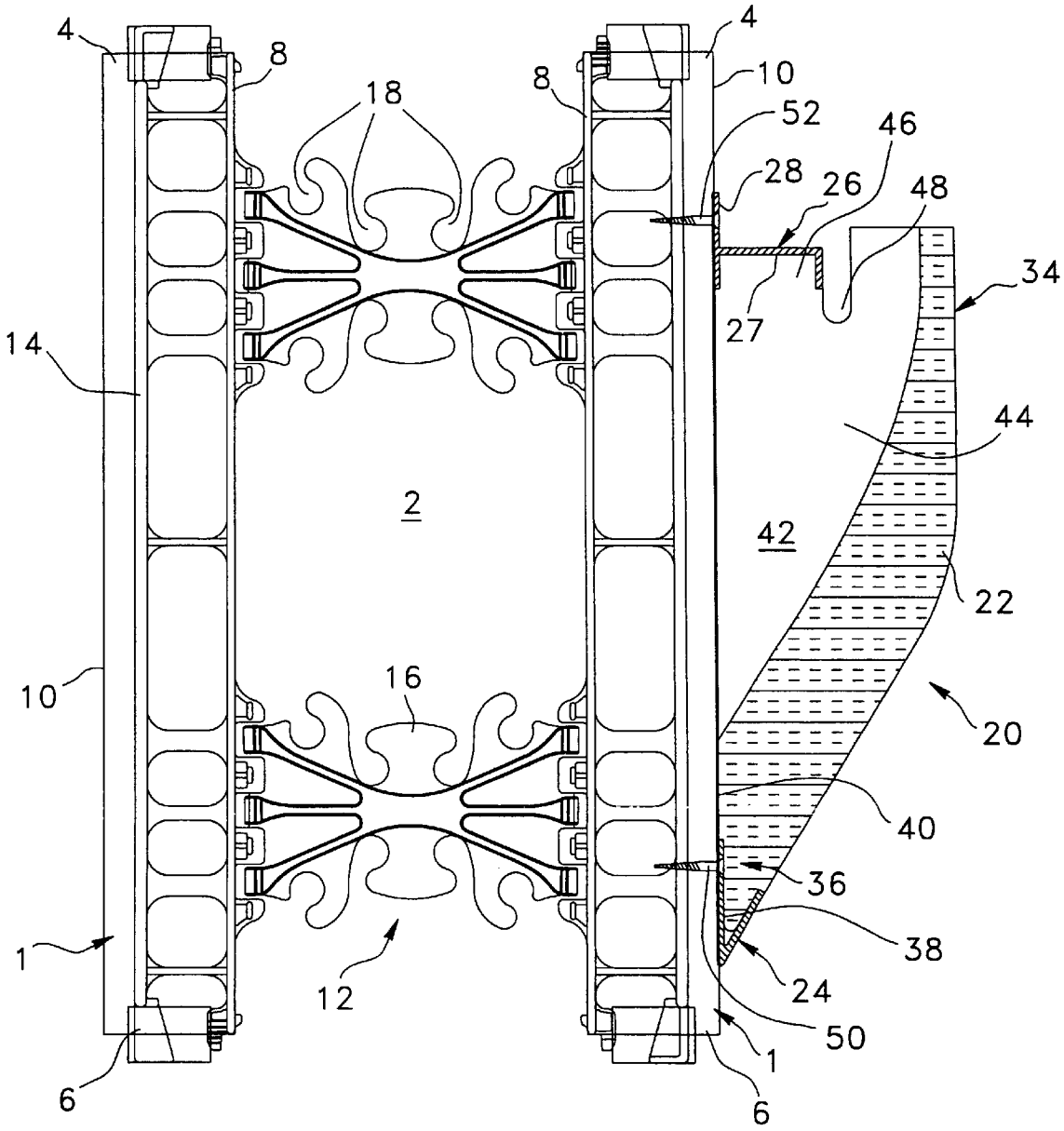
FIG. 2 is a cross-sectional side view of a ledger mould of FIG. 1 shown mounted against a foam panel of a form wall assembly.
Figure 6:
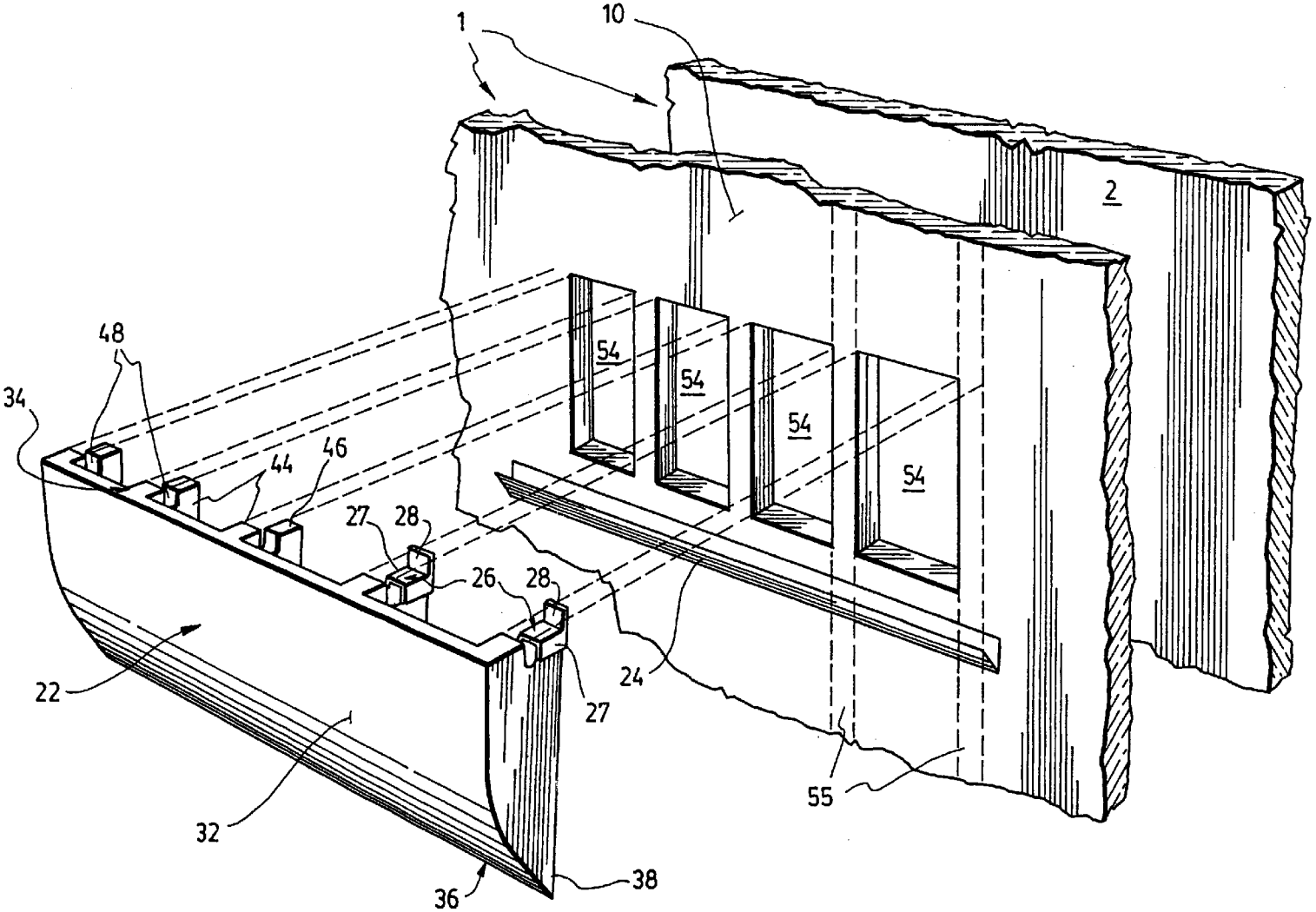
FIG. 6 is a perspective view of one of the ledger moulds shown in FIG. 1 prior to being placed on a foam panel where holes cut out of the planar outside face of the foam panel are clearly visible.

Referring to FIGS. 1, 2 and 6, the wall form assembly comprises a pair of spaced-apart parallel foam panels (1) defining therebetween a cavity (2) for the setting of a flowable material for building an insulated wall. Each foam panel (1) of the pair has a top (4), a bottom (6), an inside face (8) and a planar outside face (10). A plurality of connectors (12) are used to interconnect the foam panels (1) in a spaced-apart relationship to form the cavity (2) between the inside face (8) of each panel (1). Each connector (12) comprises two opposite and elongated flange plates (14) that extend longitudinally and deep inside the respective foam panels (1). A link element (16), also called web member, interconnects the flange plates (14). The link element (16) is preferably provided with rod-receiving cut outs (18) each adapted to receive a steel rod (not illustrated) used to reinforce the concrete. The flange plates (14) can be removable from the foam panels (1), as described for example in U.S. Pat. No. 5,625,989. However in the preferred embodiment, the flange plates (14) are preferably permanently embedded within the foam panels (1).

Referring now more particularly to FIGS. 2 to 5, the ledger mould assembly (20) comprises an elongated mould (22) made of foam and mounting means (24, 26) to horizontally mount the mould (20) against the outside face (10) of a foam panel (1).

The mould (22) comprises a front (30), a back (32), a top (34), a bottom (36) with a tapered bottom edge (38) and a planar front face (40) spanning from top (34) to bottom (36). The mould (22) further comprises at least one, but more preferably a plurality of flared recesses (42) in the front face (40), opening outwardly and upwardly from bottom (36) to the top (34). Each two adjacent flared recesses (42) are separated by a transversal partition wall (44).

It is worth mentioning that in another embodiment of the invention, not shown in the accompanying figures, the mould (22) may lack the transversal partition walls (44) and therefore may be used to create a ledger mould (22) made up of only one flared recess (42).

Any mounting means apparent to a person skilled in the art can be used to horizontally mount the mould (22) against the planar outside face (10) of either one of the foam panels (1) of the wall form assembly with the bottom (36) of the mould (22) down and the planar front face (40) of the ledger mould (22) making contact with the planar outside face (10) of the foam panel (1). This allows the flowable material to be poured from the top (34) of the mould (22) into the flared recesses (42) to form a ledger, as shown in FIG. 1.

In the preferred embodiment illustrated in FIGS. 1 and 6, the mounting means preferably comprise a V-shaped bracket (24) to secure the bottom edge (38) of the mould (22) to the panel (1). The V-shaped bracket (24) preferably has the same length as the length of the mould (22) and a V-shaped cross section shaped to receive and support the tapered bottom edge (38) of the mould (22).

Without departing from the scope of the present invention, the mounting means could comprise, instead of a single elongated V-shaped bracket (24) as described above, a plurality of shorter V-shaped brackets which would serve the same purpose as a single longer one.

As best shown in FIGS. 2 and 6, the mounting means further preferably comprise a set of capping brackets (26), one associated with each partition wall (44) of the mould (22). All the capping brackets (26) are similar and each one comprises a cap-shaped portion (27) adapted to fit on an upwardly protruding portion (46) of the partition wall (44) and a flange (28) extending at right angle on a side of the cap-shaped portion (27).

A set of specific fasteners (50, 52) is provided for securing the V-shaped bracket (24) and the capping brackets (26) to the planar outside face (10) of the panel (1).

The fasteners (52) for the capping brackets (26) are preferably screws which screw into the flange (28) of the capping bracket (26) and then through the foam panel (1). Advantageously, and as best shown in FIG. 2, the screws (52) can be driven right into the flange plates (14) embedded in the foam panel (1).

The fasteners (50) for the V-shaped bracket (24) are preferably screws which screw into one side section of the bracket (24) and then through the foam panel (1), as shown in FIG. 2. As for the fasteners (52) used for securing the capping brackets (26), the fasteners (50) for the V-shaped brackets (24) are preferably driven right into the flange plates (14) embedded in the foam panel(1).

The fasteners (50 and 52) can be chosen from the group comprising: screws, bolts, nails or any other equivalent known to someone skilled in the art.

The capping brackets (26) and the V-shaped bracket (24) are preferably made of plastic. However, as apparent to someone skilled in the art, any other known material, such as wood or metal, exhibiting similar characteristics of strength and rigidity can be used.

Figure 3:
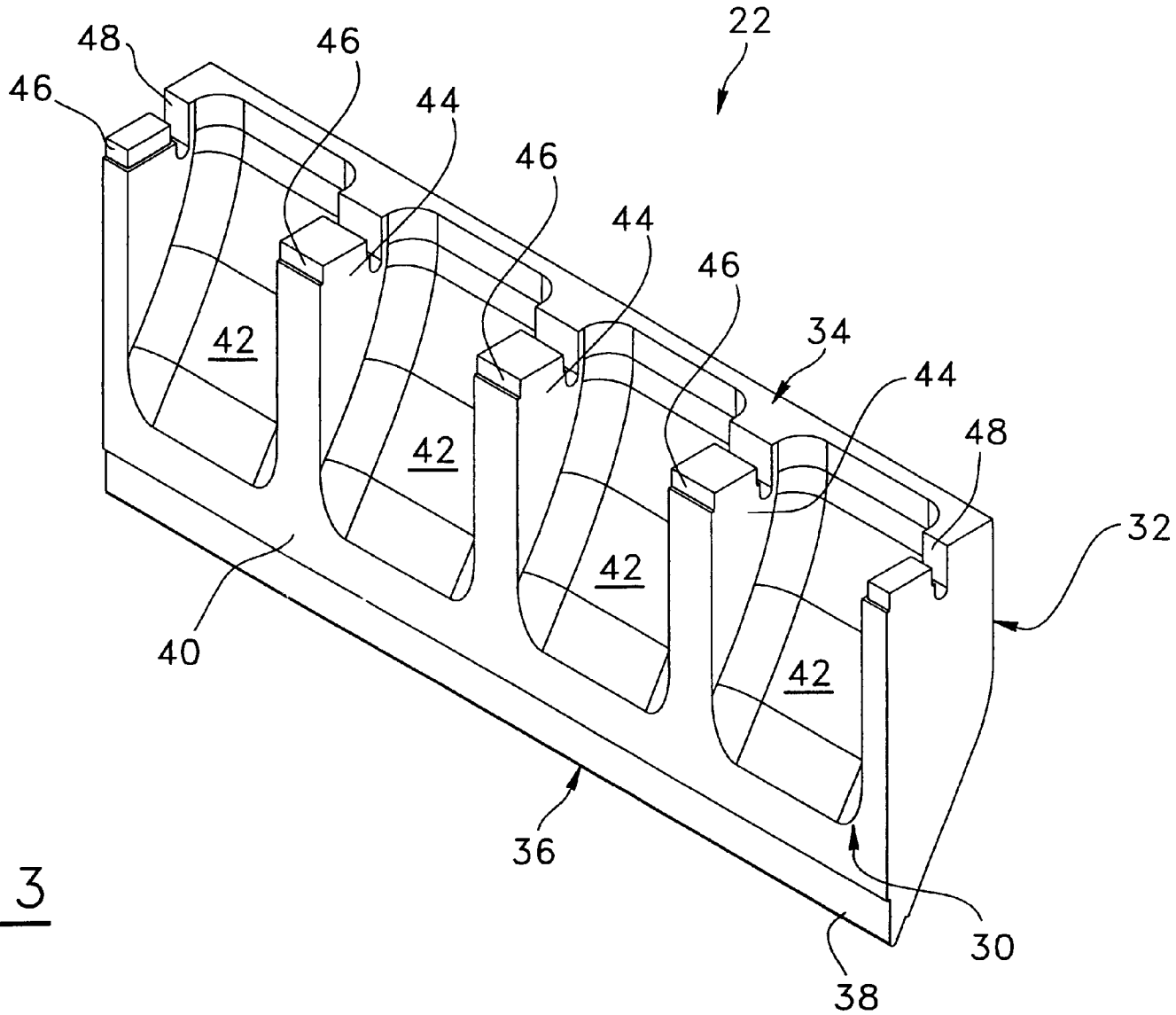
FIG. 3 is a perspective view of the ledger mould of FIG. 2.
Figure 4:
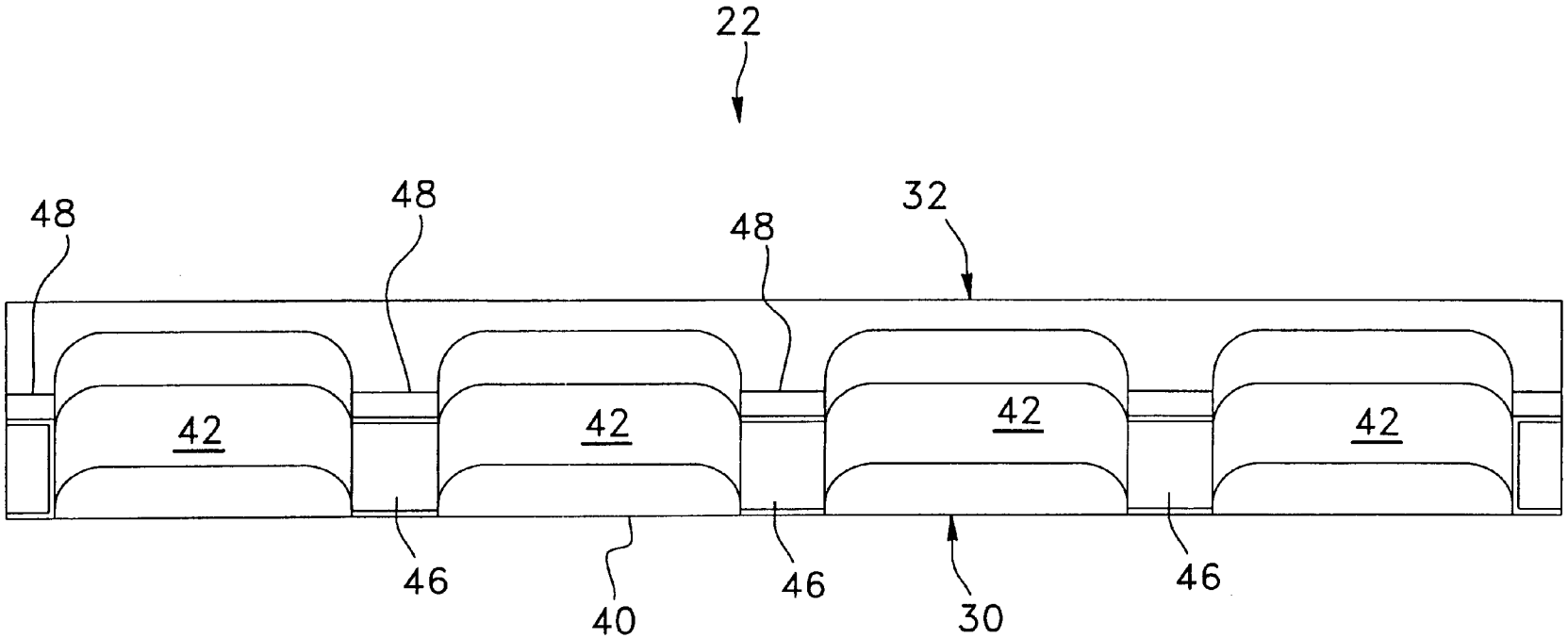
FIG. 4 is a top view of the ledger mould of FIG. 2.
Figure 5:
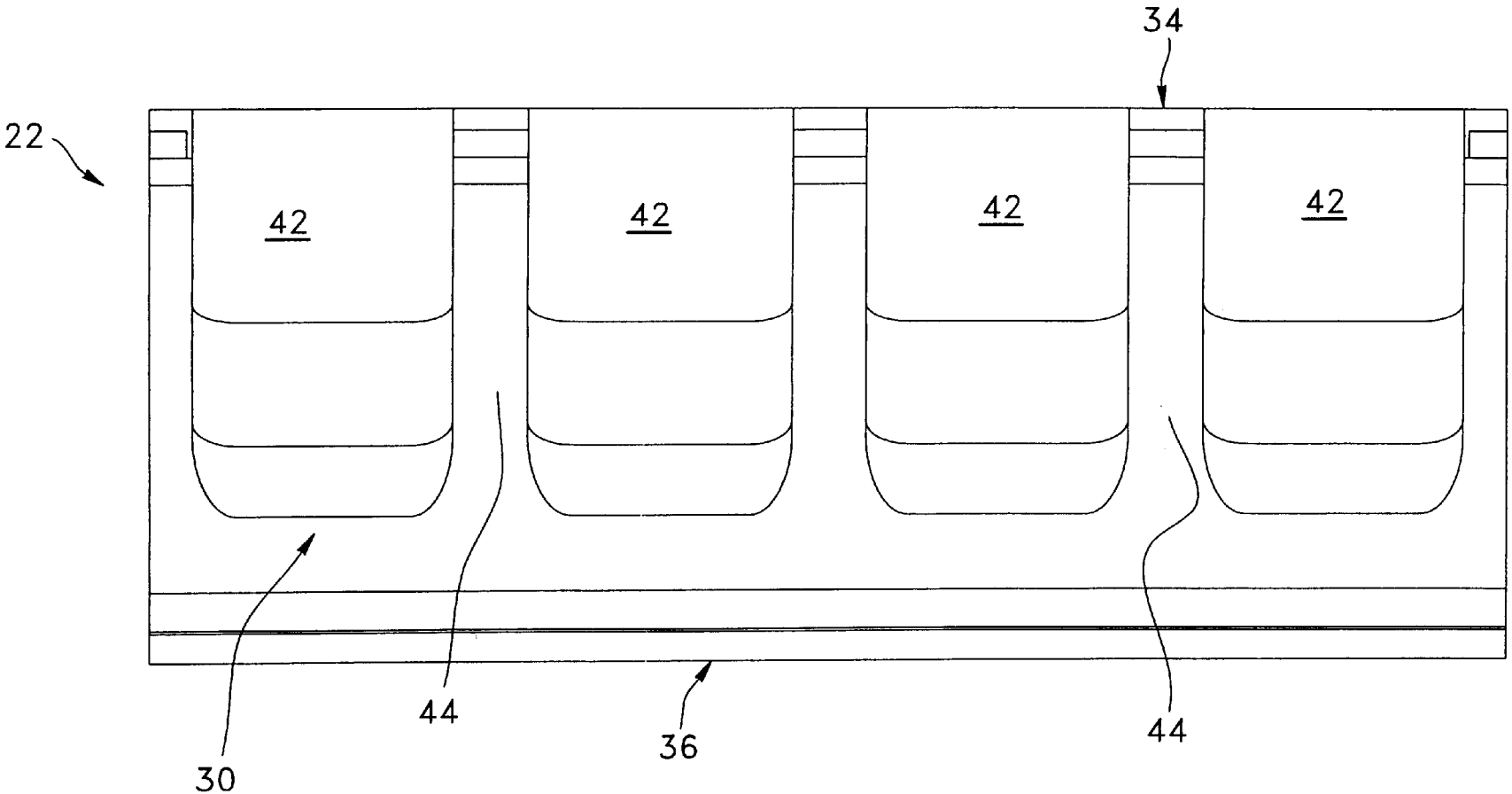
FIG. 5 is a front view of the ledger mould of FIG. 2.

As best seen in FIGS. 3, 4 and 5, each partition wall (44) has opposite side faces and a top edge provided with a rod-receiving slot (48) spanning from one side face to the other. The slots (48) of each of the partition walls (44) are aligned with one another so as to receive a reinforcing rod that can be linked to the reinforcing rods inserted into the rod-receiving cut-outs (18) of the web members (16) interconnecting the foam panels (1). Those reinforcing rods are mainly used to reinforce the concrete.

The present invention also provides a kit for building an insulated wall with a ledger. The kit comprises a pair of foam panels (1) tied together by means of connectors (12), an elongated ledger mould (22) and mounting means (24 and 26) to horizontally secure the ledger mould (22) to either one of the foam panels (1). The foam panels (1), the connectors (12), the ledger mould (22) and the mounting means (24 and 26) provided with the kit are as described hereinabove. The kit preferably comprises a plurality of ledger moulds (22) and a plurality of pairs of foam panels (1).

The present invention also provides a method for making an insulated wall with a ledger. The description of the different steps of the method of the invention will now be made in referring more particularly to FIGS. 1, 2 and 6. The method comprises the steps of: a) providing a kit as defined previously, b) setting the foam panels (1) in a spaced apart relationship, c) mounting the ledger mould (22) horizontally on the planar outside face (10) of either one of the foam panels (1), d) cutting and removing the foam material of the foam panel (1) then facing the flared recesses (42) to provide a hole (54) permitting a full fluid communication between the flared recesses (42) and the cavity (2) located between the foam panels (1) and e) pouring a flowable and hardening material into the flared recesses (42) and the cavity (2) located between the foam panels (1).

It is worth mentioning that the cut outs in the foam panel (1) can be made either prior or after the installation of the ledger mould (22) against the foam panel (1). Advantageously, those cut outs could be made at the manufacture prior to the shipping of the foam wall assembly to the site of construction.

Preferably, step c) of mounting the ledger mould (22) comprises the step of securing the bottom edge (38) and an upper part of the ledger mould (22) to the planar outside face (10) of the foam panel (1). The step of securing the bottom edge (38) of the mould (22) preferably comprises the step of providing a V-shaped bracket (24) as defined above. The V-shaped bracket (24) is positioned and screwed horizontally on the planar outside face (10) of the panel (1). The screws (50) used to secure the V-shaped bracket (24) are preferably driven right into the flange plates (14) extending in the foam panel (1). The bottom edge (38) of the ledger mould (22) is then inserted in the V-shaped bracket (24) to be supported thereon. Obviously, to build a level ledger, the V-shaped bracket (24) should be properly levelled before it is fastened to the planar outside face (10) of the panels (1).

The step of securing the upper part of the ledger mould (22) preferably comprises the steps of providing a set of capping brackets (26) as described hereinabove and positioning the ledger mould (22) horizontally so that each partition wall (44) faces a corresponding flange plate (14) in the foam panel (1). The upwardly protruding portion (46) of each partition wall (44) is then covered with one of the capping brackets (26) and the flange (28) thereof is screwed to its corresponding flange plate (14) in the foam panel (1). Preferably, each foam panel (1) will sport a design (55) on its planar outside face (10), as shown in FIG. 1, helping the user in determining where the flange plates (14) are embedded in the foam panel (1).

The method preferably further comprises the step of adding a reinforcing framework to the ledger mould (22) and the cavity (2) located between the foam panels (1) to reinforce the structure before the pouring of the flowable hardening material and thus obtaining a reinforced concrete. More preferably, when reinforcing the ledger mould (22) with reinforcing rods, a rod is inserted in the rod-receiving slot (48) located on the top edge of the mould (22).

The flowable material is preferably concrete, but as it is obvious to a person skilled in the art, any other flowable material with the same characteristics, such as strength, can be used without departing from the spirit or the scope of the invention.

Although a preferred embodiment of the present invention has been described in detail herein and illustrated in the accompanying drawings, it is to be understood that the invention is not limited to this precise embodiment and that various changes and modifications may be effected therein without departing from the scope or spirit of the present invention.

What is claimed is:

1. A ledger mould assembly for use with a wall form assembly, the wall form assembly comprising a pair of spaced-apart parallel foam panels defining therebetween a cavity for the setting of a flowable material for building an insulated wall, the ledger mould being for receiving a hardening flowable material and integrally forming a ledger to the wall, the mould assembly comprising:

an elongated mould made of foam and having:

a front, a back, a top and a bottom;

a planar front face spanning from top to bottom;

a tapered bottom edge;

a plurality of flared recesses in the front face, opening outwardly and upwardly from bottom to the top; and a transversal partition wall separating each two adjacent flared recesses, each partition wall having a top edge including an upwardly protruding portion;

mounting means for horizontally mounting said mould against a planar outside face of one of said foam panels with the bottom down and the planar front face of the ledger mould contacting said planar outside face of the foam panel and thereby allowing flowable material to be poured from the top of the mould into said flared recesses to form a ledger, the mounting means comprising:

a V-shaped bracket shaped to receive and support the tapered bottom edge of the mould;

a set of capping brackets each comprising:

a cap-shaped portion adapted to fit on the upwardly protruding portion of each partition wall; and a flange extending at right angle on a side of the cap-shaped portion; and a set of fasteners to secure the V-shaped and capping brackets to the planar outside face of the panel.

2. A ledger mould as claimed in claim 1 wherein, the capping brackets and the V-shaped bracket are made of plastic.

3. A ledger mould assembly for use with a wall form assembly, said wall form assembly comprising a pair of spaced-apart parallel foam panels defining therebetween a cavity for the setting of a flowable material for building an insulated wall, the ledger mould being for receiving a hardening flowable material and integrally forming a ledger to the wall, the mould assembly comprising:

an elongated mould made of foam and having:

a front, a back, a top and a bottom;

a planar front face spanning from top to bottom;

a tapered bottom edge; and at least one flared recess in the front face, opening outwardly and upwardly from bottom to the top; and mounting means for horizontally mounting said mould against a planar outside face of one of said foam panels with the bottom down and the planar front face of the ledger mould contacting said planar outside face of the foam panel and thereby allowing flowable material to be poured from the top of the mould into said at least one flared recess to form a ledger, wherein the mounting means comprise:

a V-shaped bracket shaped to receive and support the tapered bottom edge of the mould; and a fastener to secure the V-shaped bracket to the planar outside face of the panel.

4. A ledger mould as claimed in claim 3, wherein the mould comprises:

a plurality of said at least one flared recess; and a transversal partition wall separating each two adjacent flared recesses.

5. A ledger mould as claimed in claim 4, wherein the mounting means further comprise:

a set of capping brackets each comprising:

a cap-shaped portion adapted to fit on an upwardly protruding portion of the partition walls; and a flange extending at right angle on a side of the cap-shaped portion; and a fastener to secure each flange to the planar outside face of the panel.

6. A ledger mould as claimed in claim 5, wherein each of the partition walls has opposite side faces and a top edge, the top edge including a rod-receiving slot spanning from one side face to the other; the slot of any partition wall being aligned with the slot of each of the other partition walls.

7. A ledger mould as claimed in claim 5 wherein, the capping brackets and the V-shaped brackets are made of plastic.

8. A kit for building an insulated wall with a ledger, the kit comprising:

a pair of foam panels tied together by means of connectors, each panel having a top, a bottom, an inside face and a planar outside face; the foam panels being settable in a spaced-apart relationship for forming a cavity between the inside face of each panel for receiving a flowable material;

an elongated ledger mould made of foam for forming a ledger to the wall, the ledger mould having:

a front, a back, a top and a bottom;

a planar front face spanning from top to bottom;

a tapered bottom edge; and at least one flared recess in the front face, opening outwardly and upwardly from bottom to the top; and mounting means for horizontally mounting said mould against said planar outside face of either one of said foam panels with the bottom down and the planar front face contacting said planar outside face of the panel and thereby allowing flowable material to be poured from the top of the ledger mould into said at least one flared recess to form a ledger, wherein each of said connectors comprises:

two opposite and elongated flange plates extending longitudinally and deep inside a respective one of said foam panels; and a link element interconnecting the flange plates.

9. A kit as claimed in claim 8, wherein the mounting means comprise:

a V-shaped bracket shaped to receive and support the tapered bottom edge of the mould; and a fastener to secure the bracket to said planar outside face of the panel.

10. A kit as claimed in claim 9, wherein the mould comprises:

a plurality of said at least one flared recess; and a transversal partition wall between each two adjacent flared recesses.

11. A kit as claimed in claim 10, wherein the mounting means further comprises:

a set of capping brackets each comprising a cap-shaped portion adapted to fit on an upwardly protruding portion of said partition walls and a flange extending at right angle on a side of the cap-shaped portion; and a fastener to secure each flange to the planar outside face of said foam panel.

12. A kit as claimed in claim 11, wherein each of the partition walls has opposite side faces and a top edge including a rod-receiving slot spanning from one side face to the other; the slot of any partition wall being aligned with the slot of each of the other partition walls.

13. A kit as claimed in claim 12 wherein, the capping brackets and the V-shaped brackets are made of plastic.

14. A kit as claimed in claim 8, wherein said flange plates of the connectors are permanently embedded within the foam panels.

15. A method for making an insulated wall with a ledger, comprising the steps of:

a) providing a kit as defined in claim 8;

b) setting the foam panels in said spaced apart relationship;

c) mounting the ledger mould horizontally on the planar outside face of either one of the foam panels;

d) cutting and removing the foam material of the foam panel then facing said at least one flared recess for providing a full fluid communication between said at least one flared recess and said cavity between the foam panels; and e) pouring a flowable and hardening material into said at least one flared recess and said cavity between the foam panels.

16. A method as claimed in claim 15, wherein step c) of mounting comprises the steps of:

securing the tapered bottom edge and an upper part of the ledger mould to said planar outside face.

17. A method as claimed in claim 16, wherein the step of securing the bottom edge comprises the steps of:

providing a V-shaped bracket shaped to receive and support the tapered bottom edge of the mould;

positioning the V-shaped bracket horizontally on said planar outside face of the foam panel;

screwing the V-shaped bracket to the flange plates provided in the foam panel; and inserting the tapered bottom edge of the ledger mould in the V-shaped brackets.

18. A method as claimed in claim 17, wherein the ledger mould comprises a plurality of said at least one flared recess and a transversal partition wall between each two adjacent flared recesses, and the step of securing the upper part of the ledger mould comprising the steps of:

providing a set of capping brackets each comprising a cap-shaped portion adapted to fit on an upwardly protruding portion of the partition walls and a flange extending at right angle on a side of the cap-shaped portion;

positioning horizontally the ledger mould so that each partition wall faces a corresponding one of said flange plates in the foam panel;

covering the upwardly protruding portion of each partition wall with one of said capping brackets; and screwing the flange of each of the capping brackets to its corresponding flange plate.

* * * * *